US007913353B2

(12) United States Patent
Park et al.

(10) Patent No.: US 7,913,353 B2
(45) Date of Patent: Mar. 29, 2011

(54) VACUUM CLEANER

(75) Inventors: Tae Jin Park, Gimhae-si (KR); Yun Hee Park, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 276 days.

(21) Appl. No.: 12/018,500

(22) Filed: Jan. 23, 2008

(65) Prior Publication Data

US 2008/0109985 A1 May 15, 2008

(51) Int. Cl.
*A47L 5/34* (2006.01)
*A47L 7/00* (2006.01)

(52) U.S. Cl. ..... 15/358; 15/339; 15/354

(58) Field of Classification Search ..... 15/358
See application file for complete search history.

(56) References Cited

U.S. PATENT DOCUMENTS

| | | | | |
|---|---|---|---|---|
| 4,437,205 | A * | 3/1984 | Koland | 15/354 |
| 2005/0204505 | A1 * | 9/2005 | Kashiwagi | 15/319 |
| 2006/0000052 | A1 * | 1/2006 | Budd | 15/361 |
| 2006/0021184 | A1 * | 2/2006 | Hawkins et al. | 15/377 |
| 2006/0085095 | A1 * | 4/2006 | Reindle et al. | 700/258 |

* cited by examiner

*Primary Examiner* — Bryan R Muller
(74) *Attorney, Agent, or Firm* — Ked & Associates, LLP

(57) ABSTRACT

A vacuum cleaner is provided. The vacuum cleaner includes a suctioning nozzle, a height adjusting unit, a manipulating part, a position sensing part, and a display part. The suctioning nozzle suctions air including dust. The height adjusting unit adjusts the height of the suctioning nozzle. The manipulating part manipulates the height adjusting unit. The position sensing part senses the height adjusted by the height adjusting unit. The display part externally displays the height sensed by the position sensing part.

16 Claims, 6 Drawing Sheets

VACUUM CLEANER

BACKGROUND

The present disclosure relates to a vacuum cleaner.

In general, a vacuum cleaner is an apparatus that uses suctioning force generated by a suctioning motor installed within a main body to suction air including dust, and then filter the dust within the main body.

Vacuum cleaners can largely be categorized into canister vacuum cleaners that have a suctioning nozzle connected via a hose to a main body, and upright vacuum cleaners that have the suctioning nozzle and main body integrally formed.

In an upright vacuum cleaner, the main body is capable of rotating with respect to the suctioning nozzle. The suctioning nozzle is height adjustable with respect to a floor surface.

SUMMARY

Embodiments provide a vacuum cleaner.

In one embodiment, a vacuum cleaner includes: a suctioning nozzle suctioning air including dust; a height adjusting unit adjusting a height of the suctioning nozzle; a manipulating part manipulating the height adjusting unit; a position sensing part sensing the height adjusted by the height adjusting unit; and a display part displaying the height sensed by the position sensing part to an outside.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

Figure 1:
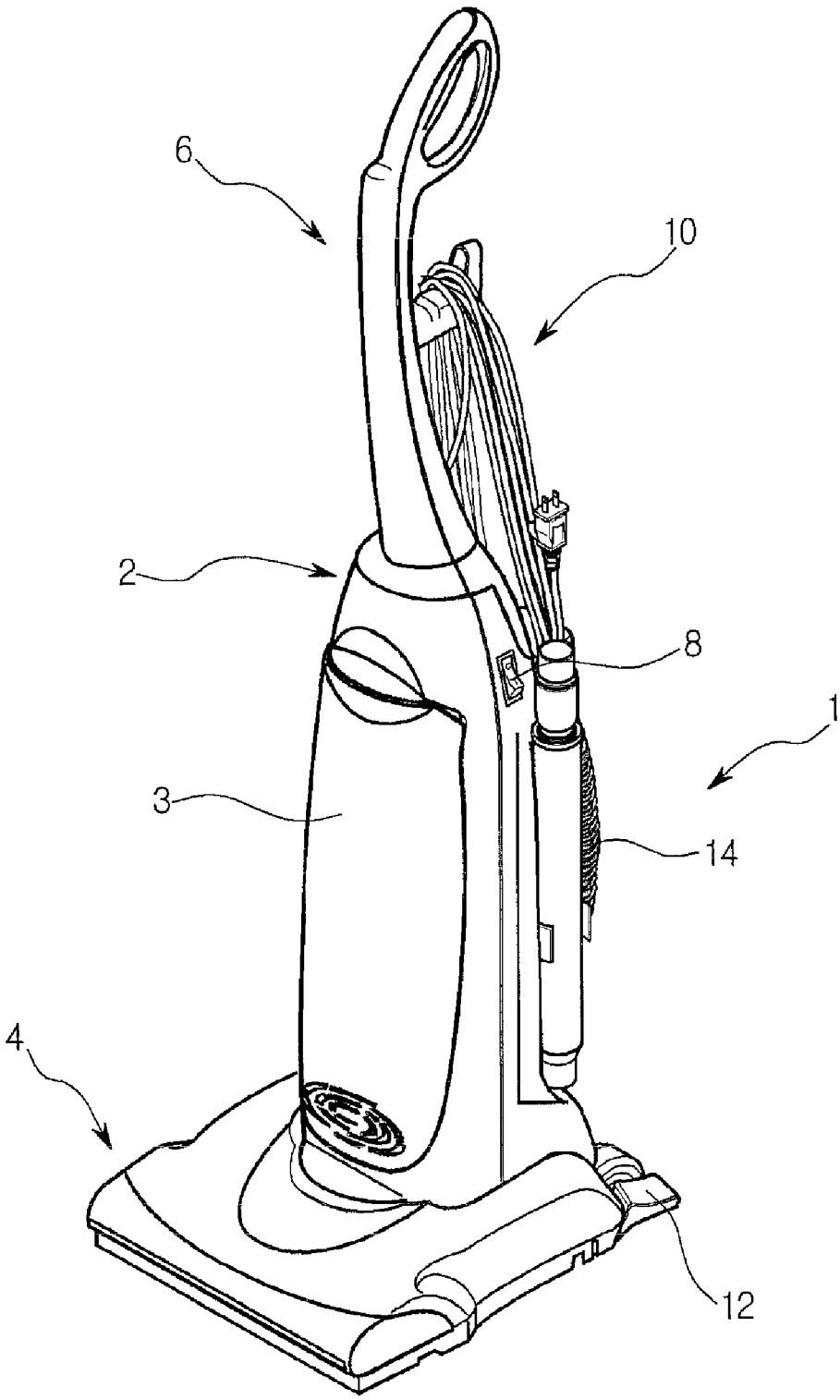
FIG. 1 is a perspective view of a vacuum cleaner according to present embodiments.

FIG. 1 is a perspective view of a vacuum cleaner according to present embodiments.

Referring to FIG. 1, an upright vacuum cleaner is exemplarily described in the present embodiments. The vacuum cleaner includes a main body 2 with a built-in suctioning force generating member that generates suctioning force and a filtering member that removes impurities from suctioned air, and a suctioning nozzle 4 installed at the bottom of the main body 2 to suction impurities from a floor surface.

The main body 2 has a cover 3 coupled thereto, to enable the filtering member provided within the main body to be inserted and removed. A handle 6 is formed at the top of the main body 2. A switch 8 is provided on a side of the main body 2 to control the operation of the main body 2.

The main body 2 is coupled rotatably to the suctioning nozzle 4. A lever 12 is provided at the rear of the suctioning nozzle 4, to control the rotation of the main body 2 with respect to the suctioning nozzle 4, with the main body 2 in an upright position. Also, a manipulating part (described below), for adjusting the height of the suctioning nozzle 4, is provided at the rear of the suctioning nozzle 4.

The operation of the above-configured vacuum cleaner will be briefly addressed below. When a user connects a cord 10 to an electrical socket, power may be supplied to the vacuum cleaner.

In this state, when a switch 8 installed on one side of the main body 2 is manipulated, the operation of the vacuum cleaner commences. When the operation of the vacuum cleaner begins, impurities on a floor are suctioned together with air through a suctioning port defined in the undersurface of the suctioning nozzle 4. The user grasps the handle 6 and moves the suctioning nozzle 4 to perform cleaning.

In the above cleaning operation, the suctioned air including impurities is guided through a connecting hose 14 into the main body 2. The air guided into the main body 2 is removed of impurities by means of a filtering member built in the main body 2. When required, the connecting hose 14 may be removed from the suctioning nozzle 4, so that a user may clean crevices using only the connecting hose 14.

The air that is removed of impurities by the filtering member within the main body 2 passes the internal suctioning force generating member, and is then expelled to the outside of the vacuum cleaner.

Figure 2:
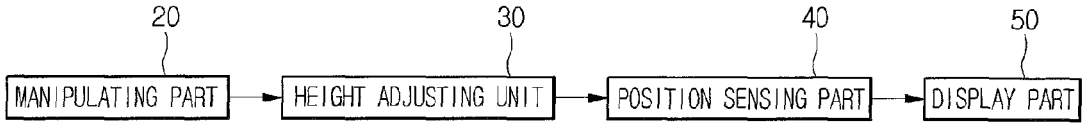
FIG. 2 a schematic block diagram of suctioning nozzle controls on a vacuum cleaner.

FIG. 2 a schematic block diagram of suctioning nozzle controls on a vacuum cleaner.

Referring to FIG. 2, the vacuum cleaner 1 includes a manipulating part 20 that can be pressed by a user's foot, a height adjusting unit 30 that adjusts the height of the suctioning nozzle according to manipulation of the manipulating part 20, a position sensing part 40 with a rotating part connected to the height adjusting unit 30, and a display part 50 that displays the height of the suctioning nozzle 4 in response to an electrical signal output from the position sensing part 40.

In detail, the manipulating part 20 is rotatably coupled to the rear portion of the suctioning nozzle 4. The optimum position of the manipulating part 20 may differ according to the configuration of the lower nozzle 4.

The height adjusting unit 30 is rotated in one direction by the manipulation of the manipulating part 20, to incrementally adjust the height of the suctioning nozzle 4.

The position sensing part 40 is a potentiometer with a rotating part that rotates in engagement to the height adjusting unit 30, and is model no. "N-15" manufactured by the company, PIPHER, according to the present embodiment.

The rotating part of the position sensing part 40 is engaged with the height adjusting unit 30, so that the height of the suctioning nozzle 4 may be automatically determined by the position sensing part 40 according to the operation of the height adjusting unit 30.

The display part 50 may be formed above the suctioning nozzle 4 to enable the height of the nozzle 4 to be easily checked by a user. To allow a user to easily check the height of the suctioning nozzle 4 while manipulating the manipulating part 20, the display part 50 may be disposed proximately to the manipulating part 20. However, there are no restrictions to the position of the display part 50, which may be formed on the handle 6, for example.

Information displayed by the display part 50 includes information on the height of the suctioning nozzle 4 sensed by the position sensing part 40. The display part 50 may display the height of the suctioning nozzle 4 in increments.

The display part 50 may be formed of a display part including a plurality of light emitting diodes (LEDs), or a liquid crystal display (LCD). If a plurality of LEDs is used, the number of illuminated LEDs may differ according to height. That is, when the suctioning nozzle 4 is in its lowermost position, the LEDs may remain unlighted, and the number of LEDs that are illuminated may increase as the position of the suctioning nozzle 4 is raised.

When an LCD is employed on the other hand, the suctioning nozzle may, for example, be depicted at height increments through bars. The method of depicting increments in height of the suctioning nozzle is not limited with the use of an LCD.

In addition, when using LEDs to emit light to the outside, any configuration may be used to emit light.

Figure 3:
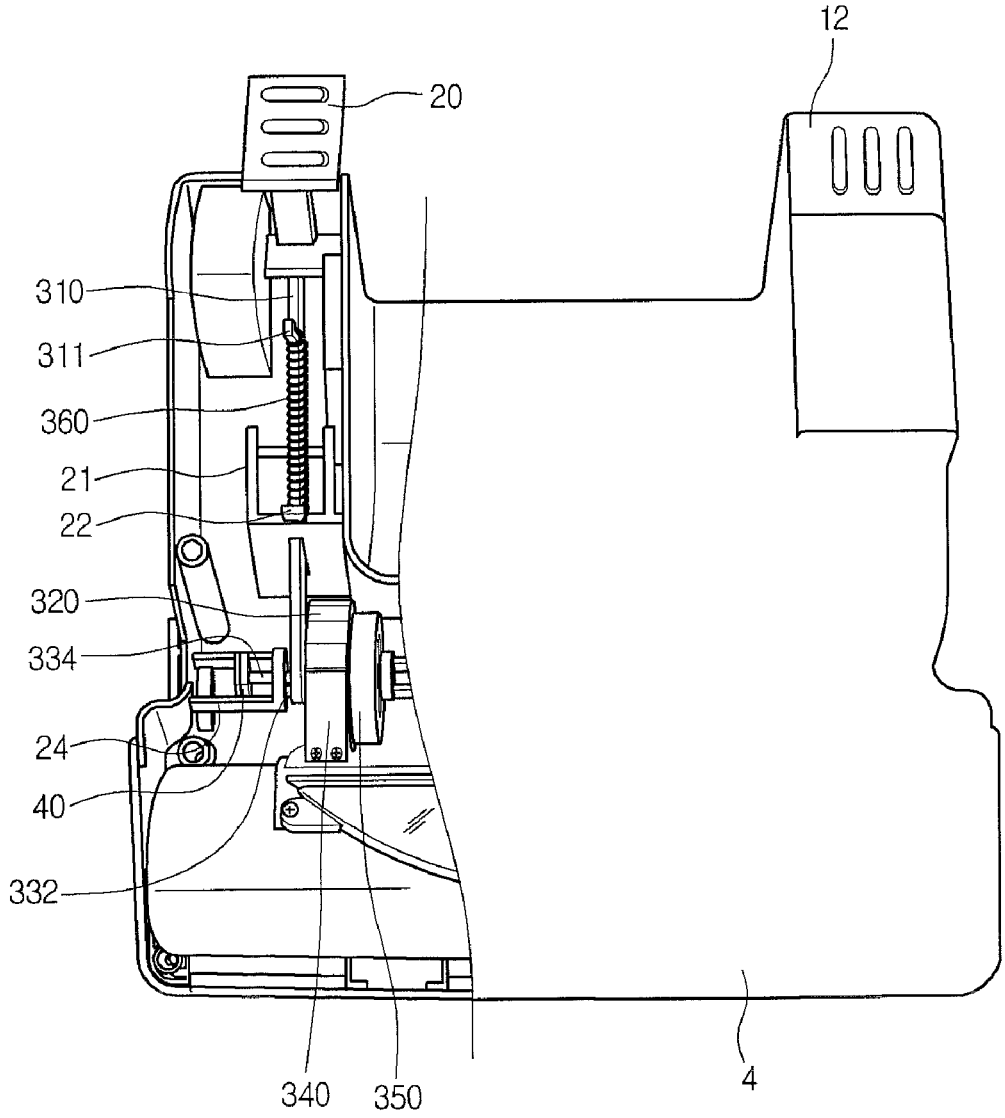
FIG. 3 a cutaway view showing the structure of a suctioning nozzle.
Figure 4:
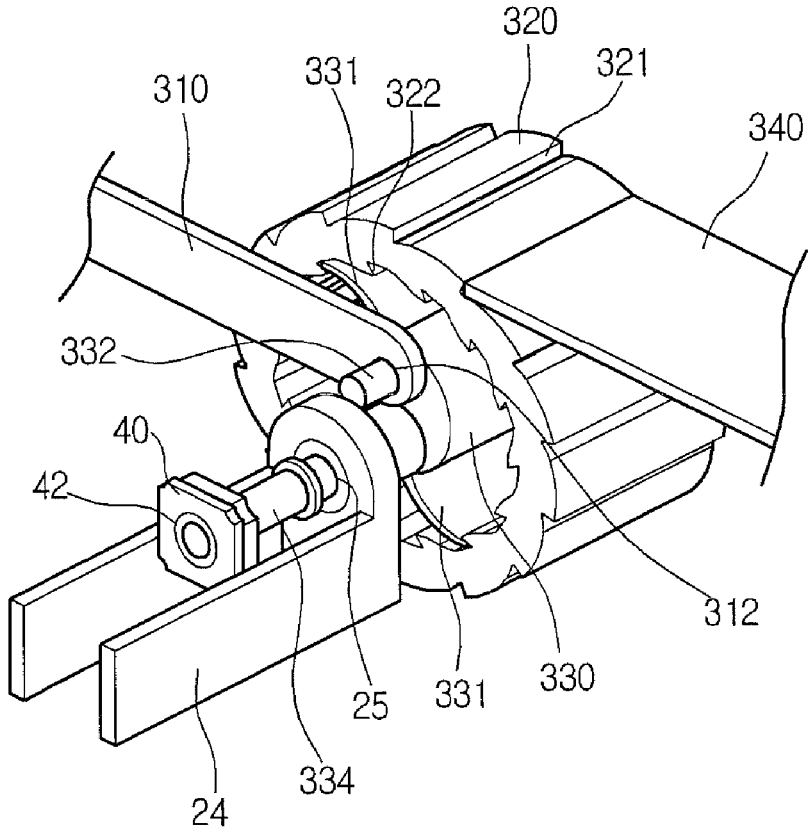
FIG. 4 is an enlarged perspective view showing the height adjusting unit in FIG. 3.
Figure 5:
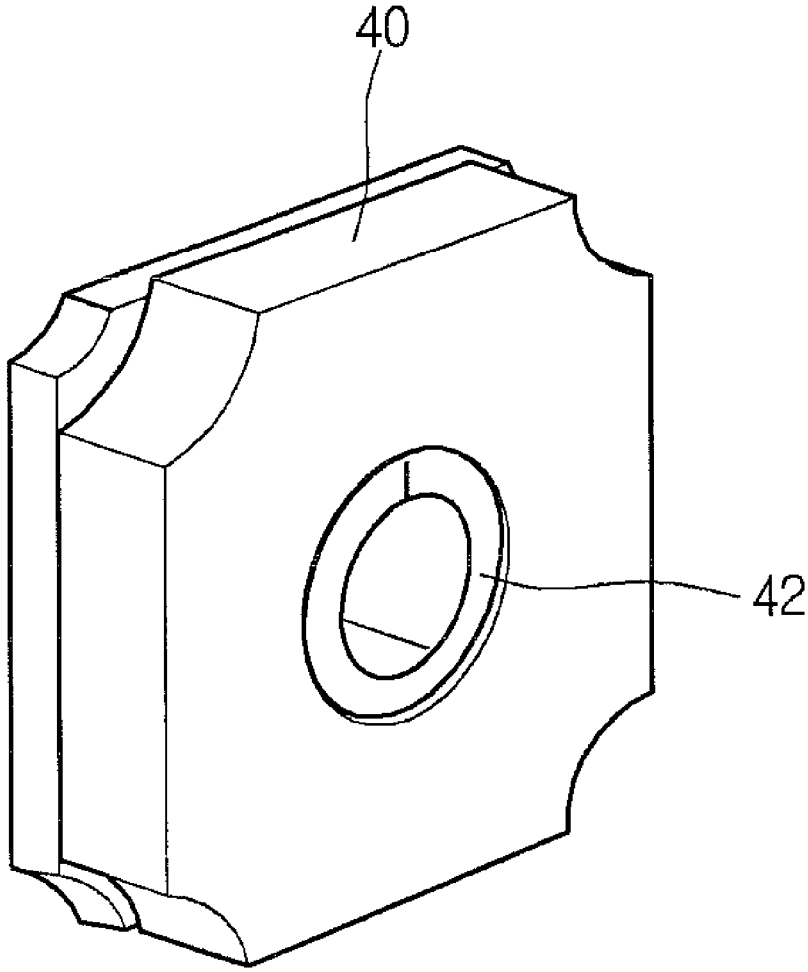
FIG. 5 is a detailed perspective view of a position sensing part.

FIG. 3 a cutaway view showing the structure of a suctioning nozzle, FIG. 4 is an enlarged perspective view showing the height adjusting unit in FIG. 3, and FIG. 5 is a detailed perspective view of a position sensing part.

Referring to FIGS. 3 to 5, when viewed from the top of the suctioning nozzle, the manipulating part 20 is formed on one side at the rear of the suctioning nozzle 4, and the lever 12 is formed on the other side at the rear of the suctioning nozzle 4.

The height adjusting unit 30 includes a rotating member 320 that rotates, a transferring part 310 that transfers manipulative force from the manipulating part 20 to the rotating member 320, a cam 330 provided inside the rotating member 320 and coupled to the transferring part 310 to rotate the rotating member 320, and a stopping guide 340 that stops the rotating member 320 after a certain amount of rotation in one direction.

In detail, the transferring part 310 is elongated in a front-to-rear direction, with one end rotatably coupled to a coupling part 332 formed on the cam 330. The coupling part 332 is cylindrical, and the transferring part 310 defines a through-hole 312 through which the coupling part 332 passes.

A supporting part 21 is formed on the suctioning nozzle 4 to support the transferring part 310 and guide the movement of the transferring part 310. The transferring part 310 passes through the supporting part 21. An elastic member 360 is coupled to the supporting part 21 and the transferring part 310.

A first coupling rib 311 formed on the transferring part 310 and is coupled to one end of the elastic member 360, and a second coupling rib 22 is formed on the supporting part 21 and is coupled to the other end of the elastic member 360. Accordingly, when a user removes force after applying manipulating force to the manipulating part 20, the elastic member 360 restores the manipulating part 20 to its original position.

The rotating member 320 is rotated in only one direction by the transferring part. That is, the rotating member 320 may be a ratchet. The ratchet is configured as a serrated wheel that is rotated in only one direction through interaction with a pawl, and is prevented from rotating in the reverse direction. Here, the stopping guide 340 functions as the pawl.

The rotating member 320 is rotated in a counterclockwise direction in FIG. 4 (toward the manipulating part). A plurality of outer slots 321 is formed in the outer circumference of the rotating member 320 to define the starting points of the serrations. When the stopping guide 340 is disposed at an outer slot 321, the rotating member 320 is prevented from rotating clockwise.

A height adjusting part 350 is integrally formed at one side of the rotating member 320. The height adjusting part 350 is rotated in concert with the rotating member 320 to adjust the height of the suctioning nozzle 4.

The cam 330 is rotatably coupled inside the rotating member 320. The cam includes a plurality of rotating guides 331 formed around its outer circumference, and a plurality of inner slots 322 is defined in the inner circumference of the rotating member 320.

When the cam is rotated with the rotating guide 331 disposed at an inner slot 322, the rotating member 320 is rotated in the same direction as the cam 330 through the rotating guides 331.

The rotation shaft 334 of the cam 330 is supported by a mounting part 24 formed on the suctioning nozzle 4. The mounting part 24 defines a through-hole 25 through which the rotation shaft 334 passes.

The position sensing part 40 is fixed to the mounting part 24. The rotation shaft 334 is passed through the through-hole 25 and coupled to the position sensing part 40.

That is, the mounting part 24 not only fixes the position sensing part 40, but also fixes and guides the rotation of the rotation shaft 334 extending from the cam 330.

A rotating part 42 is provided at the center of the position sensing part 40 and rotates in engagement with the rotation shaft 334, and the position sensing part 40 senses the rotation of the rotating part 42 to determine the height of the suctioning nozzle 4.

In the present embodiment, model no. "N-15" used as the position sensing part 40 is an "endless rotation" type ratchet whose rotating part 42 at the center thereof can rotate infinitely. The position sensing part 40 is engaged with the rotation shaft 334, and separates data on the height of the suctioning nozzle 4 (already separated into multiple levels) into a plurality of levels to relay to the display part 50, for every one turn of the rotating part 42. That is, the position sensing part 40 discerns by how much the rotating part 42 has rotated from a reference position, to sense the height of the suctioning nozzle 4.

Below, a detailed description of the operating process of the vacuum cleaner will be given with reference to FIG. 6.

Figure 6:
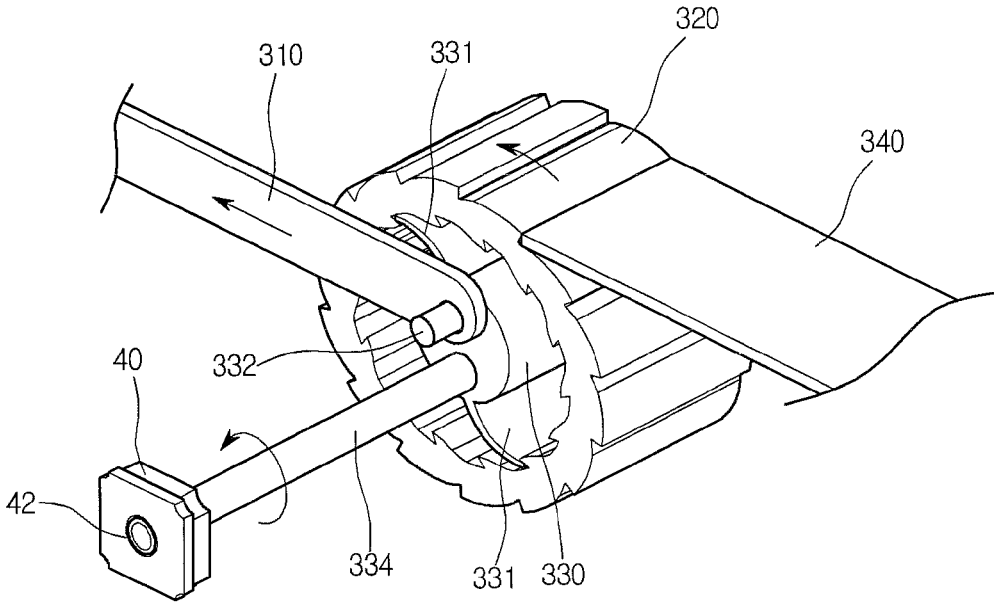
FIG. 6 is perspective view showing the operation of a height adjusting unit.

FIG. 6 is perspective view showing the operation of a height adjusting unit.

Referring to FIG. 6, the rotating member 320 is stopped by the stopping guide 340 positioned at an outer slot 321 from rotating clockwise.

In this state, when a user steps on the manipulating part 20, the transferring part 310 moves to the left. Thus, the cam 330 is rotated counterclockwise by the transferring part 310.

When the cam 330 rotates counterclockwise, the rotating guide 331 formed on the outer circumference of the cam 330 rotates the rotating member 320 counterclockwise.

The amount by which the rotating member 320 is rotated counterclockwise is an amount that allows the stopping part 340 to insert into the subsequent outer slot.

Accordingly, when a user releases the pressure on the manipulating part 20, the transferring part 310 is moved to the right by means of the restoring force of the elastic member 360. Then, the stopping guide 340 inserts into the next outer slot 321, preventing reverse rotation (clockwise) of the rotating member 320.

When the rotating member 320 is rotated counterclockwise, the height adjusting part 350 is rotated, thereby adjusting the height of the suctioning nozzle 4 through the rotation of the height adjusting part 350. This is made possible due to the oblong shape of the rotating member 320, as shown in the diagrams. Thus, the rotation of the rotating member 320 becomes the cause for the height variation of the height adjusting part 350 (that is engaged to the rotating member 320.)

When the cam 330 is rotated counterclockwise, the rotating part 42, fixed and coupled to the rotation shaft 334, rotates by a predetermined angle. The position sensing part 40 senses the fixed state of the suctioning nozzle 4 according to the amount by which the rotating part 42 has rotated.

The information sensed by position sensing part 40 is relayed to the display part 50, which displays the height of the suctioning nozzle 4.

The present embodiment employs a method using an oblong rotating member 320 to adjust for optimally respective heights along the rotating member 320 according to the rotation of the rotating member 320, thereby automatically adjusting the height of the height adjusting part 350 engaged to the rotating member 320.

However, this method is limited to only one embodiment, and in other embodiments, the height adjusting part 350 may be directly engaged with the cam 330 to rotate therewith.

Any reference in this specification to "one embodiment," "an embodiment," "exemplary embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner, comprising:

a suctioning nozzle that suctions in air including dust;

a height adjusting device that adjusts a height of the suctioning nozzle;

a manipulating part that manipulates the height adjusting device;

a position sensing part that senses the height of the suctioning nozzle adjusted by the height adjusting device; and a display part that displays the height of the suctioning nozzle sensed by the position sensing part, wherein the height adjusting device comprises:

a height adjusting part that adjusts the height of the suctioning nozzle;

a rotating member coupled to the height adjusting part, the rotating member being configured to rotate together with the height adjusting part;

a cam coupled to the rotating member to rotate the rotating member, the cam including a rotating shaft that extends outward therefrom; and a transferring part that transfers a manipulative force from the manipulating part to the cam, wherein the position sensing part comprises a rotating part that includes a recess formed on a first surface that faces the cam, wherein a distal end of the rotating shaft is positioned inside the recess, the rotating part being configured to rotate inside an aperture within the position sensing part in connection with the rotation of the cam, and wherein the position sensing part is configured to sense information regarding the rotation of the rotating part to determine a position of the height adjusting part.

2. The vacuum cleaner according to claim 1, wherein the cam comprises a coupling part that protrudes therefrom, and wherein one end of the transferring part has a through-hole through which the coupling part passes.

3. The vacuum cleaner according to claim 1, further comprising a stopping guide that prevents the rotating member from rotating in a second direction opposite to a first direction in which the rotating member is rotated by a predetermined angle.

4. The vacuum cleaner according to claim 3, wherein the stopping guide is fixed to the suction nozzle.

5. The vacuum cleaner according to claim 3, wherein the cam comprises at least one rotating guide that guides the rotation of the rotating member in the first direction, and wherein the least one rotating guide extends from an outer periphery of the cam.

6. The vacuum cleaner according to claim 5, wherein a plurality of inner slots are defined in an inner circumference of the rotating member, and wherein the at least one rotating guide is located configured to be positioned in at least one of the plurality of inner slots.

7. The vacuum cleaner according to claim 1, wherein the height adjusting part is integrally formed with the rotating member.

8. The vacuum cleaner according to claim 1, wherein the display part incrementally displays the height sensed by the position sensing part.

9. The vacuum cleaner according to claim 1, wherein the suctioning nozzle comprises a mounting part on which the position sensing part is installed, and wherein the rotation shaft of the cam passes through the mounting part.

10. The vacuum cleaner according to claim 1, wherein the rotating member is disposed between the position sensing part and the height adjusting part.

11. A vacuum cleaner height adjusting assembly, comprising:

a cam;

a rotating member that is configured to rotate with the cam;

a height adjusting part connected to the rotating member, and configured to rotate together therewith, wherein the height adjusting part is configured to adjust a height of a suction nozzle; and a position sensor including a position sensing part, a rotating part positioned in an aperture within the position sensing part and configured to rotate within the position sensing part and a rotating shaft that includes a first end and a second end, wherein the first end is connected to the rotating part of the position sensing part and the second end is connected to and rotates with the cam, and wherein the position sensor is configured to determine the height of the suction nozzle based on the rotation of the sensor rotating shaft in only a first direction.

12. The vacuum cleaner height adjusting assembly of claim 11, wherein the rotating member has an oblong shape.

13. The vacuum cleaner height adjusting assembly of claim 11, wherein the rotating member includes a recess, and wherein the cam is positioned inside the recess.

14. The vacuum cleaner height adjusting assembly of claim 13, further comprising one or more rotating guides that connects the cam and the rotating member such that rotation of the cam in the first direction drives the rotating member in the first direction.

15. The vacuum cleaner height adjusting assembly of claim 14, wherein the rotating member further comprises a plurality of inner slots formed on an inner surface of the recess, and wherein the one or more rotating guides are configured to be positioned inside one or more of the plurality of inner slots to drive the rotating member in the first direction.

16. The vacuum cleaner height adjusting assembly of claim 14, wherein the rotating member further comprises a plurality of outer slots formed on an outer surface of the rotating member, and wherein a stopping guide is configured to be positioned inside one of the plurality of outer slots to prevent rotation of the rotating member in a second direction.

* * * * *